United States Patent [19]

Stoehr et al.

[11] Patent Number: 4,464,920

[45] Date of Patent: Aug. 14, 1984

[54] MACHINE FOR ROLLER FORMING METAL LOUVERS

[75] Inventors: Herbert M. Stoehr, New Berlin; John J. Toben, Milwaukee, both of Wis.

[73] Assignee: Artos Engineering Company, New Berlin, Wis.

[21] Appl. No.: 437,362

[22] Filed: Oct. 27, 1982

[51] Int. Cl.[3] ..... B21D 13/00; B21D 28/26; B21D 28/36

[52] U.S. Cl. ..... 72/186; 72/386; 72/701; 29/163.5 R

[58] Field of Search ..... 72/186, 187, 386, 387, 72/177, 701, 702, 185, 204, 379; 29/163.5 R; 98/121 R

[56] References Cited

U.S. PATENT DOCUMENTS

| | | | |
|---|---|---|---|
| 475,700 | 5/1892 | Ohl | 72/186 |
| 2,089,326 | 8/1937 | Bailey | 72/186 |
| 2,222,081 | 11/1940 | Leigh | 29/163.5 R |
| 3,203,079 | 8/1965 | Smith et al. | 29/163.5 R |
| 3,446,049 | 5/1969 | Greis | 72/186 |

*Primary Examiner*—Lowell A. Larson
*Attorney, Agent, or Firm*—James E. Nilles

[57] ABSTRACT

Disclosed is a roller forming machine for converting a flat metal strip into a louver having long, narrow fins that extend lengthwise of the strip and are all bent laterally in one direction oblique to the plane of the strip. The fins are produced by a pair of fin forming rollers which slit the strip and bend out the fins to a larger acute angle to the plane of the strip than is desired in the finished louver. The strip then tends to twist along its length due to asymmetrical residual stresses generated by fin formation. To remove the twist, the strip is passed between cylindrical straightening rollers whereby the fins are bent partway back towards coplanarity with the strip, thus generating new residual stresses which oppose the original ones due to fin forming. One straightening roller is adjustable towards and from the other so that said new residual stresses can be empirically brought into equilibrium with the original ones.

3 Claims, 9 Drawing Figures

MACHINE FOR ROLLER FORMING METAL LOUVERS

Field of the Invention

This invention relates to a machine for producing metal louvers by roller forming, and is more particularly concerned with a roller forming machine for converting metal strip stock into louvers or grills that are straight and untwisted even though they have long, narrow, laterally adjacent fins that extend parallel to the length of the strip and are all bent out of the plane of the strip with their surfaces inclined laterally in one and the same direction to that plane.

BACKGROUND OF THE INVENTION

Metal louvers are installed to permit a free flow of ventilating air but to exclude rain, snow and other blown materials from the space to be ventilated. In most cases, therefore, all of the fins or vanes of a louver must be inclined in one and the same direction so that the louver will be effective to shed or deflect air-borne particles.

There is an increasing demand for relatively long metal louvers that are intended for installation in roof overhang soffits, having fins that extend lengthwise parallel to the length of the louver strip. Heretofore such soffit louvers have been produced by the stamping process, which required an expensive press and expensive dies and which was relatively slow because of the intermittent movement of the sheet metal as it was first advanced to feed it into the jaws of the press and then halted for closure of the press.

It was known, in general, that elongated articles such as soffit louvers could be produced more quickly and at lower cost by roller forming than by stamping. In roller forming the stock moves constantly at a substantially steady rate, in contrast to the stop-start movement of stock through a stamping press, and forming rollers are, as a rule, substantially less expensive than corresponding stamping dies because they can be made on a lathe.

Although the advantages of roller forming were obvious, soffit louvers have heretofore been regarded as inherently not adaptable to roller forming because of the previously unsolved problem of obtaining straightness of the finished product. When a strip of sheet metal is passed lengthwise through forming rollers, as for bending a flange along an edge of it or rolling a longitudinal ridge into it, the forming operation generates internal stresses in the metal that remain in it and tend to force it out of flatness. Such residual stresses are the result of lengthwise elongation or compression of the metal that occurred as the flange or ridge was forced out of the plane of the strip. If the strip has been roller formed to a configuration which is substantially symmetrical relative to its longitudinal centerline, the residual stresses left in it by the roller forming operation cause it to have essentially only a bow or curvature along its length, and the art is familiar with expedients for correcting this condition. However, in a strip of metal that has been roller formed to a louver with fins that extend parallel to its length and are all inclined in the same direction to the plane of the strip, the residual stresses resulting from the bending of the fins are asymmetrical to the longitudinal centerline of the strip and, moveover, such stresses reinforce one another all across the louvered width of the strip. As a result, the louver comes out of the fin forming rollers with a strong tendency to assume a marked corkscrew twist along its length.

In an effort to overcome this twisting tendency, various attempts were made at generating asymmetrical residual stresses in the louver that would offset or counterbalance the residual stresses resulting from the fin forming operation. Such attempts included the formation of a ridge in the material near one longitudinal edge of it that was subsequently rolled back to substantial flatness. None of these expedients was successful in completely and consistently eliminating twist, and some of them made matters worse by causing the louver to curve edgewise along its length.

Attempts to solve the twisting problem also showed that any truly satisfactory solution would have to be one whereby a change in the character or thickness of the metal being worked could be accommodated by the mere making of a simple adjustment, rather than requiring, for example, a modification of a forming roller or the making of a new forming roller on the basis of laborious calculations or tests.

SUMMARY OF THE INVENTION

The general object of the present invention is to provide apparatus whereby straight, flat metal strip stock can be roller formed to provide the strip with bent-out portions which are elongated lengthwise of the strip and which have their surfaces laterally inclined at an acute angle to the plane of the strip, as in the case of the obliquely bent fins of a louver, and whereby a finished piece is produced that is true and untwisted notwithstanding that the strip stock is formed across its width to a configuration which is markedly asymmetrical relative to the longitudinal centerline of the strip.

Stated another way, it is an object of this invention to provide apparatus for roller forming straight, flat metal strip stock into elongated louvers having lengthwise extending fins that are all inclined to the plane of the strip in the same direction across their widths, and whereby the normally existing tendency for such asymmetrical workpieces to be twisted along their lengths is overcome so that the louvers produced by the apparatus are straight and true.

It is also an object of the invention to provide very simple and effective straightening means for removing the twist from roller formed louvers and similar roller formed products that have a tendency to be markedly twisted as they emerge from the forming rollers, said straightening means comprising a roller pair through which the strip passes after it leaves the forming rollers and whereby the straightening operation is performed substantially continuously with the forming operation.

Another and more specific object of the invention is to provide simple straightening means for producing, in roller formed louvers and similar workpieces, residual stresses which offset or counterbalance the residual stresses left in the workpieces as a result of their passage through the forming rollers and which thus eliminate the twist from the workpieces, said straightening means being adjustable so that the amount of reforming needed to bring the louvers to true straightness can be quickly and easily determined empirically and so that the apparatus can be readily adapted for operation with different kinds of metal.

These and other objects of the invention which will appear as the description proceeds are obtained in a louver forming machine wherein metal strip stock is constrained to move lengthwise in an advancing direction along a defined path and whereby groups of long, narrow, laterally adjacent fins are formed in said metal, each fin having its length parallel to the length of the strip and all of the fins being inclined laterally in one oblique direction to the plane of the strip. The machine of this invention is characterized by at least one pair of cooperating forming rollers between which the strip passes and by which the strip is slitted to define fins and the fins are bent out of the plane of the strip to a lateral inclination in said oblique direction at a first acute angle to said plane; a pair of straightening rollers spaced in said advancing direction from said forming rollers and between which the strip passes, said straightening rollers having substantially cylindrical surface portions which engage the fins and which are spaced apart by a distance to bend the fins partially back towards coplanar relationship with the remainder of the strip and thus to a second and smaller acute angle to said plane, thereby producing a set of residual stresses in the strip that oppose the set of residual stresses produced by bending the fins to said first acute angle; and means for adjustingly shifting one of said straightening rollers towards and from the other one, for increase and decrease, respectively, of the magnitude of the residual stresses produced by the straightening rollers so that the opposing sets of residual stresses in the strip can be empirically brought to a substantial equilibrium such that each said set of residual stresses prevents the other from imposing a twist upon the strip.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 2:
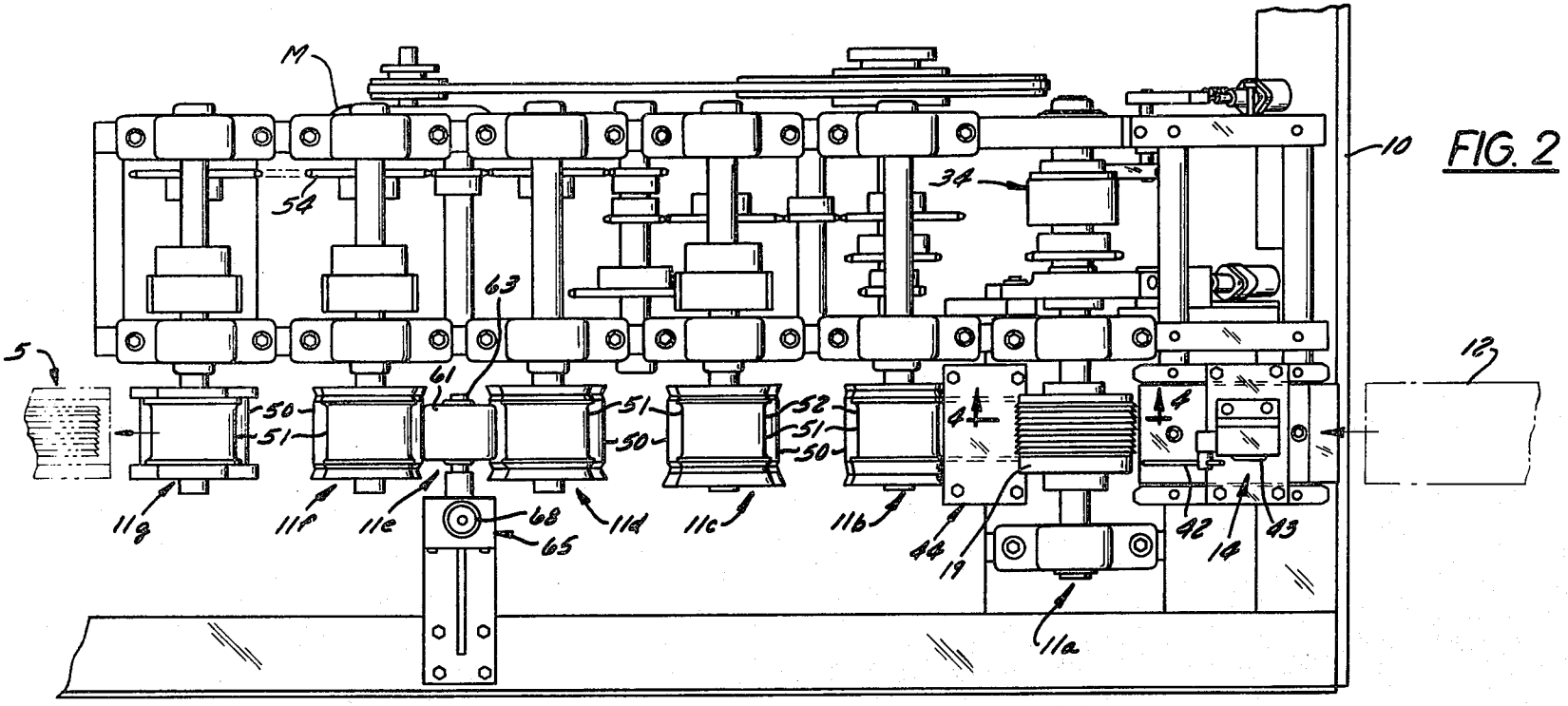
FIG. 2 is a plan view of the roller forming machine.
Figure 1:
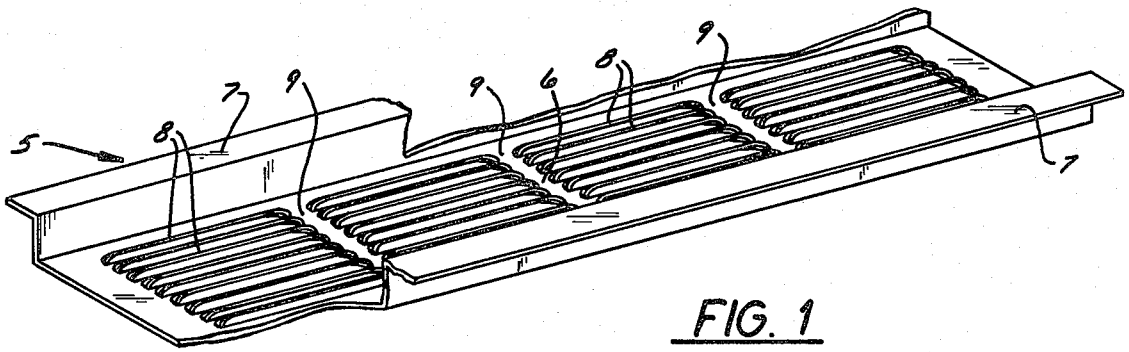
FIG. 1 is a perspective view of a soffit louver produced on a roller forming machine embodying the principles of this invention.
Figure 3:
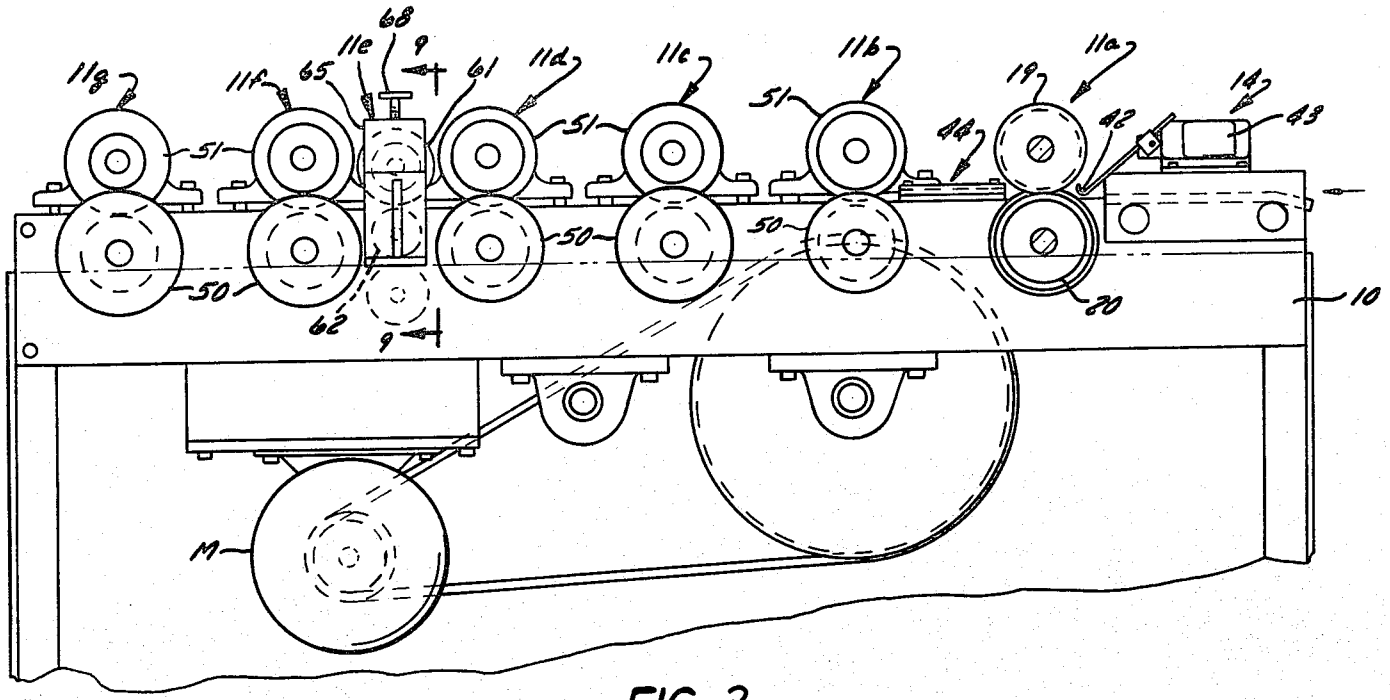
FIG. 3 is a view of the roller forming machine in side elevation.

A louver 5 that is made on a roller forming machine embodying the principles of this invention is typically eight feet long, although it can be made in substantially shorter lengths, as explained hereinafter. It has a hat-shaped cross-section, with a vaned or finned central panel 6 and coplanar flanges 7 along its opposite longitudinal edges that are in flatwise offset relation to the central panel. The long, narrow fins or vanes 8 in the central panel 6, which extend parallel to the length of that panel, are arranged in identical groups that are spaced apart at uniform intervals along the louver by flat, unslitted zones 9 of the central panel.

A roller forming machine for making louvers 5 in accordance with the principles of this invention is generally conventional insofar as it comprises an elongated frame or bed 10 and a plurality of roller stands **11*a*, 11*b* . . . 11*g* that are secured to the bed at spaced intervals along its length. Each of the roller stands comprises an upper and a lower roller between which a strip 12** passes as it advances lengthwise in one direction through the machine.

In the preferred operation of the roller forming machine, precut lengths of strip stock are successively fed into it at a steady rate of advance. The preferred mechanism 14 for cutting and feeding such lengths of strip stock is not here shown in detail because it is fully disclosed in the copending U.S. patent application of H. M. Stoehr, Ser. No. 310,620, filed Oct. 31, 1981 now U.S. Pat. No. 4,394,829, issued July 26, 1983 for Flying Shear for Metal Strip Stock, assigned to the assignee of this application. Obviously, the precut lengths 12 of strip stock could be fed into the roller forming machine in any other suitable manner, as by means of a conventional feeder that draws precut strip stock lengths one-by-one off of a supply pile. The lengths 12 of sheet metal stock that are fed to the roller forming machine are herein referred to as strips.

The first pair of forming rollers encountered by a strip 12 as it enters the roller forming machine is a fin forming roller pair at the roller stand **11*a*, comprising an upper roller 19 and a lower roller 20. These rollers 19 and 20 cooperate to slit the strip lengthwise for defining the louver fins 8**, and at the same time they bend the fins laterally out of the plane of the remainder of the strip.

Figure 4:
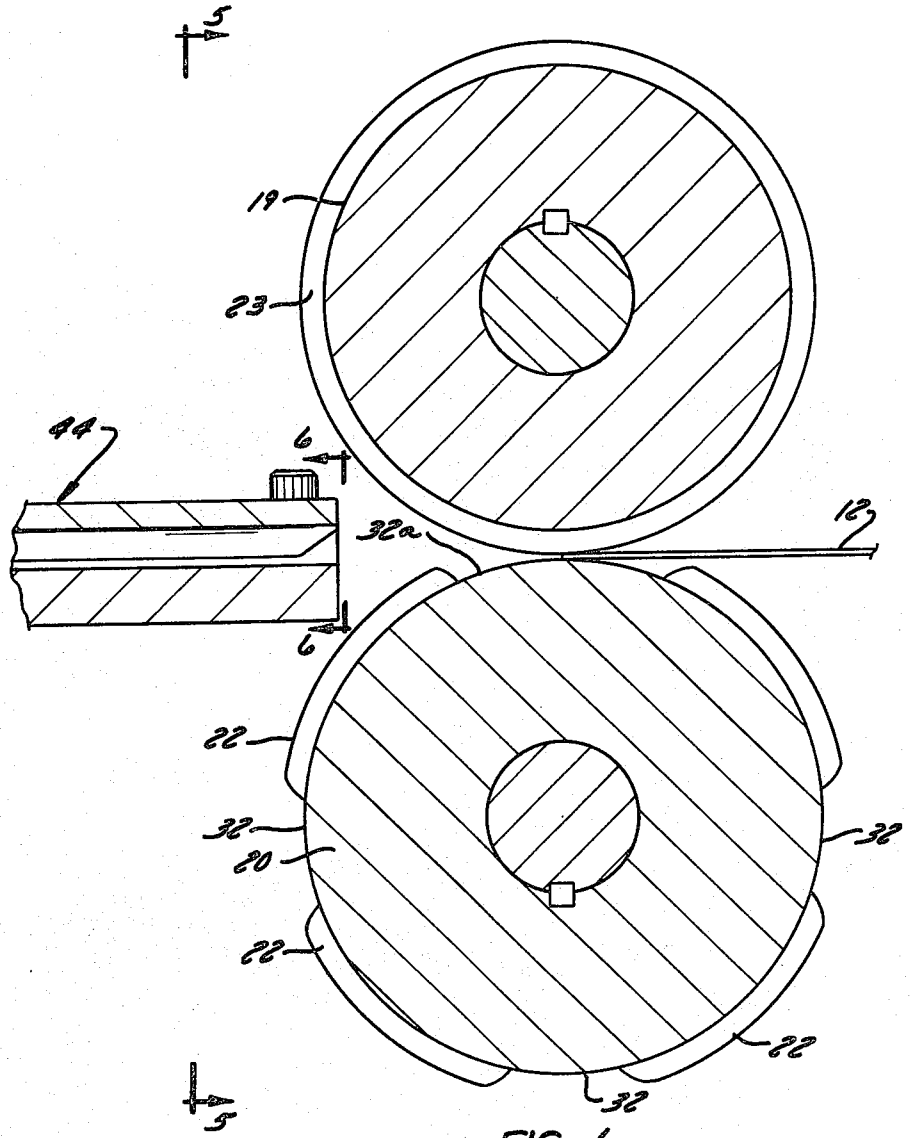
FIG. 4 is a detail view in section through the fin forming rollers, taken on the plane of the line 4—4 in FIG. 2, on a larger scale than FIG. 2.
Figure 5:
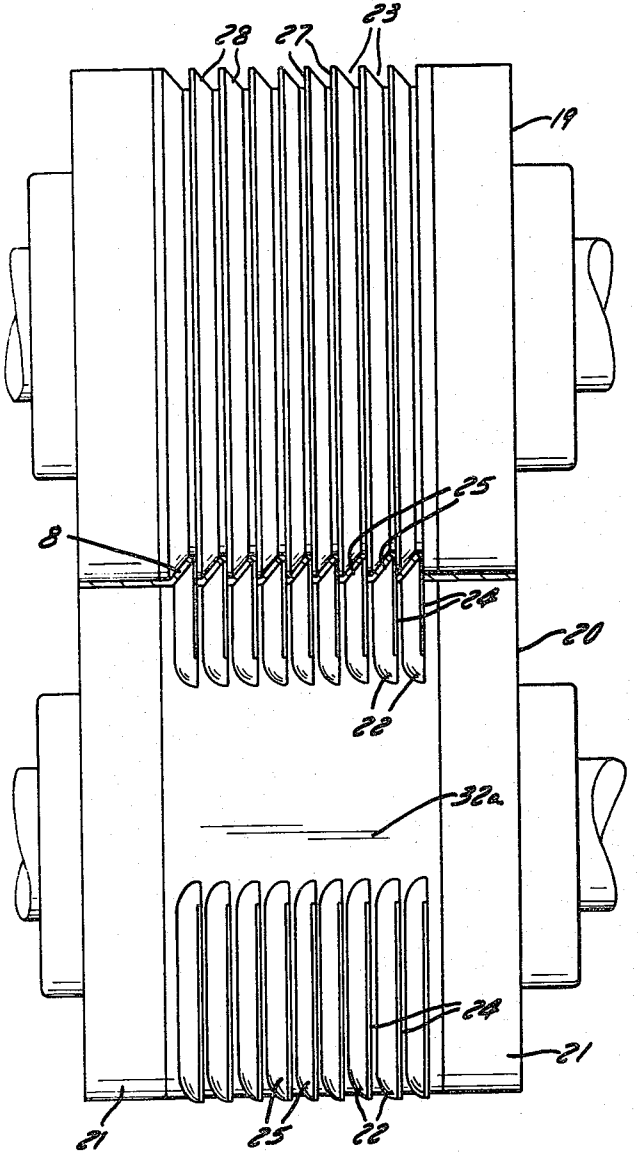
FIG. 5 is a detail view of the fin forming rollers, taken on the plane of the line 5—5 in FIG. 4.
Figure 6:
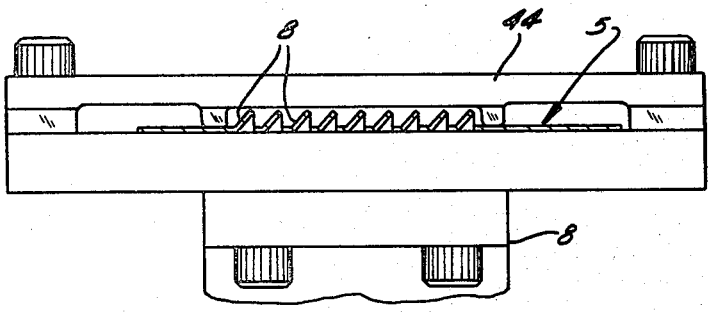
FIG. 6 is a detail view of the stripper, taken on the plane of the line 6—6 in FIG. 4.
Figure 9:
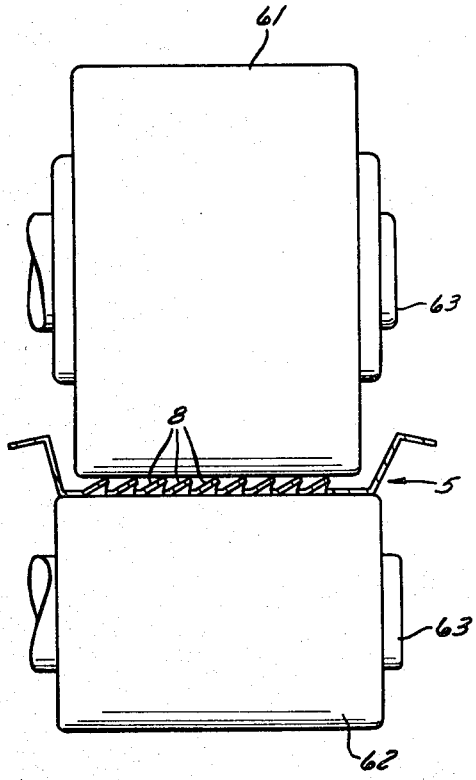
FIG. 9 is a view of the straightening rollers per se, shown in their cooperation to a louver strip to be straightened.
Figure 8:
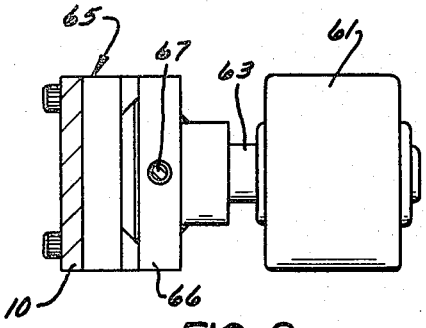
FIG. 8 is a detail view taken on the plane of the line 8—8 in FIG. 7.

The particular fin forming roller pair 19, 20 that is illustrated in FIGS. 4 and 5 produces louvers having fins 8 that are obliquely bent entirely to one side of the plane of the strip, as best seen in FIGS. 6 and 9; that is, each fin 8 has one longitudinal edge that lies substantially in the plane of the strip and has its opposite longitudinal edge spaced to one side of that plane. To that end, the lower roller 20 at the roller stand **11*a* is a male forming roller that has cylindrical end portions 21 for engaging the unfinned portions of the strip and has on its medial portion a series of axially adjacent, circumferentially extending ridges 22 that project radially beyond its cylindrical surfaces. As viewed from the side, as in FIG. 5, the ridges 22 give the lower roller 20 a saw-tooth profile. The upper roller 19, which is a female forming roller, has grooves 23 that extend circumferentially around it to receive the ridges 22 on the lower roller. The grooved portion of the upper roller 19** also has a saw-tooth profile in side view.

Each ridge 22 on the lower forming roller 20 has one side surface 24 that is a shearing surface lying in a plane normal to the axis of the roller, and has an opposite side surface 25 that serves as a bending surface and corresponds to the frustum of a cone concentric to the axis of the lower roller. Each groove 23 in the upper roller 19 has a shearing surface 27 which cooperates with a shearing surface 24 on the lower roller to shear a slit through the strip, and each groove 23 also has a bending surface 28 which cooperates with an opposing bending surface 25 on the lower roller to bend a fin out of the plane of the strip.

The ridges 22 on the lower fin forming roller 20 do not extend entirely around that roller but, instead, they are interrupted at intervals around its circumference, as at 32, to define the flat, unslitted zones 9 of the finished louver that intervene between groups of fins. Most of these interruptions 32 are of uniform circumferential extent, but one of them, designated 32*a*, extends circumferentially about twice as far as each of the others, and it constitutes a starting zone on the lower roller 20, as explained hereinafter. In this particular case, the grooves 23 in the upper roller 19 extend entirely around it circumferentially, and therefore the upper roller need not be maintained in any specific rotational relationship to the lower roller 20. Accordingly, only the lower roller 20 need be rotatably driven, as explained hereinafter, while the upper roller 19 can be an idler that is rotated by its engagement with an advancing strip.

The arrangement of ridges and grooves on the fin forming rollers must be slightly different from the one here shown if the finished louver is to have its fins bent out of the plane of the strip in such a manner that each fin has one longitudinal edge spaced to one side of that plane and its opposite longitudinal edge spaced to the other side of that plane. The necessary roller configuration will be obvious to those skilled in the art, but it may be noted that there would have to be circumferentially interrupted ridges on both rollers, and therefore the two rollers would have to be maintained in synchronized rotational relationship, as by gearing the upper roller to the lower one. In all other respects operation of the fin forming rollers would be as described hereinafter.

The circumference of the lower fin forming roller 20 is equal to a modular unit of length of the finished louver. Typically, the lower roller 20 has a one foot circumference, and strips 12 fed to the roller forming machine can be of any modular length equal to a whole number of feet. For reasons that will appear as the description proceeds, strips fed to the machine need not be of uniform length but can be fed in mixed modular lengths, in any sequence.

The mechanism 34 through which the lower fin forming roller 20 is rotatably driven is of a commercially available type, known as a one-revolution clutch, whereby the roller 20 is always brought to a stop with its unridged starting zone 32*a* uppermost and thus adjacent to the upper roller 19. Near the nip of the fin forming rollers 19, 20 is a sensor 42 which detects the presence of the leading edge of a strip being fed into the machine. The sensor 42 can be the free end of a lever that comprises the actuator for a microswitch 43. When the sensor 42 detects the presence of a strip 12 in the nip of the fin forming rollers 19, 20, it issues an output whereby the one-revolution clutch mechanism 34 drives the lower fin forming roller 20 through one revolution. If the strip has a length greater than one foot, the sensor 42 detects the continuing presence of the strip at the end of the first revolution, and the clutch 34 drives the lower roller 20 through another revolution, and so on without interruption until the trailing edge of the strip passes the sensor 42, opening the microswitch and thus causing the one-revolution clutch to stop the lower fin forming roller 20 in its starting position.

By causing the lower roller 20 always to stop at and start from the above explained starting position, and by feeding the machine with strips that have modular lengths equal to the lower roller circumference multiplied by a whole number, assurance is had that each finished louver will have unslitted zones at both of its ends and that its endmost fin groups will be spaced substantially equal distances inwardly from its ends.

As a strip 12 moves away from the fin forming roller pair at the first roller stand 11*a*, it moves through a stripper 44, which essentially comprises plates that define horizontal surfaces between which the strip is lengthwise slidably confined. The stripper 44 in effect disengages the strip from the ridges 22 on the lower fin forming roller 20 and prevents the leading edge of the strip from being deflected downward by that roller.

The strip passes out of the stripper 44 into a succession of roller pairs that form the flanges 7 along its opposite sides. These flange forming roller pairs, located at roller stands 11*b*, 11*c*, 11*d*, 11*e* and 11*g*, are generally conventional in that each comprises a lower driven roller 50 and an upper idler roller 51. The flange forming rollers at successive roller stands are configured to bend the longitudinal edge portions of the strip stepwise towards the desired flange configurations, in a manner well known in the art. At least the upper roller 51 of each pair of flange forming rollers has a relatively wide circumferential groove 52 around its middle, to clear the fins 8; and if the fins project to both sides of the plane of the strip, then the lower roller 50 of each flange forming roller pair must also have such a fin clearing circumferential groove around its middle.

As is conventional, the several lower rollers 50 of the flange forming roller pairs are driven from a single motor M through a chain drive 54 or other transmission that is common to all of them. All of these lower rollers 50 turn at the same rotational speed, but each successive lower roller 50 along the path of strip advance has a slightly larger diameter than the one ahead of it, to exert a pulling force on the strip. This arrangement avoids the "bunching" or humping of the strip that would occur if the lower rollers all had the same nominal diameter but tolerance allowances permitted one of them to have a slightly larger diameter than the next one along the strip path. The actual speed of advance of the strip through the machine is controlled by the lower roller 20 of the fin forming roller pair, and the speed difference between the strip and each subsequent driven roller along its path is compensated for by slippage.

Referring back to the fin forming rollers 19, 20, it will be observed that the bending surfaces 25 and 28 on those rollers are all inclined in one and the same direction, to produce fins 8 that are similarly all inclined in one oblique direction to the plane of the strip. As a result, the residual stresses that are left in the material by the forming of the fins are all oriented in one direction transverse to the length of the strip, and they cooperate in causing the strip to have a marked tendency to twist along its length like a corkscrew. Such twisting is eliminated according to this invention by means of a pair of straightening rollers 61, 62. To accommodate the function of the straightening rollers, the fin forming rollers 19, 20 have their mating ridges 22 and grooves 23 so configured as to form fins 9 that are bent out of the plane of the strip to a greater extent than is desired in the finished louver. This is to say that the surfaces of each fin 8 have an inclination, in the direction transverse to the length of the fin, such that the acute angle between each fin and the plane of the strip is a larger angle than the one ultimately desired. The straightening rollers 61, 62 bend the fins partway back towards coplanar relationship with the central panel 6 of the strip and thus to the desired angle.

The straightening rollers 61, 62 can be mounted on the machine bed 10 anywhere along the path of the strip after it passes through the stripper 44 and before it arrives at the final flange forming roller stand 11g. The roller forming machine here shown is an adaptation of a prior conventional flange forming machine, wherein the roller stands 11a–11d, 11f and 11g for the forming rollers are spaced at uniform intervals along the length of the machine bed, and here the stand 11e for the straightening rollers is interposed between a pair of forming roller stands 11d, 11f. Inasmuch as the straightening rollers 61, 62 are not rotatably driven, this interposition of the straightening roller stand between a pair of forming roller stands avoids the need for modifying the drive transmission for the forming rollers in adapting the flange forming machine to louver forming. There is no particular significance in locating the straightening roller stand between the fourth and the fifth roller stands 11d and 11f as here shown; the straightening rollers could be located between any other pair of forming roller stands.

The operative portion of each forming roller 61, 62 is simply a cylinder having an axial length and axial location to extend across the central panel 6 of the strip and engage all of the louver fins 8, but it should be axially short enough to clear the bent-out flanges, at opposite sides of the central panel. The straightening rollers 61, 62 are not rotatably driven because they contact only the longitudinal edges of the several fins 8. Hence, the reason there should be at least one forming roller stand located in the direction of strip advance from the straightening rollers is to pull the strip through the straightening rollers.

As the strip passes through the nip of the straightening rollers 61, 62, and they cooperate with one another to bend the fins 8 partway back to coplanar relationship with the strip, such rebending gives rise to a new set of residual stresses in the strip, which new stresses oppose those due to the original formation of the bent-out fins. If the fins are rebent to such an extent as to generate new residual stresses that are in equilibrium with those generated by the original fin formation, each set of residual stresses offsets the tendency of the other to twist the strip, and the strip remains untwisted and true after it leaves the straightening rollers.

Figure 7:
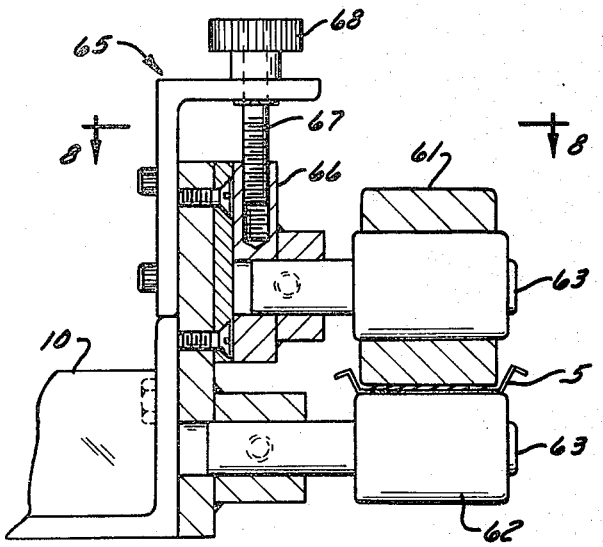
FIG. 7 is a detail view of the straightening roller stand, taken on the plane of the line 7—7 in FIG. 3.

To provide for adjustment of the extent of rebending imparted to the fins by the straightening rollers 61, 62, one of those two rollers is adjustable up and down relative to the other one. In this case it is the upper straightening roller 61 that is vertically adjustable. Each of the straightening rollers is rotatable on a sturdy shaft 63 that has cantilevered support from an upright bracket 65 at one side of the machine bed 10, as best seen in FIG. 7. The shaft 63 for the nonadjustable lower straightening roller 62 has its anchored end portion secured directly to the bracket 65, while the shaft for the upper straightening roller 61 has its anchored end fixed to a slide block 66 that is confined to up and down motion on the bracket 65. A vertically extending lead screw 67, confined to rotation in the bracket 65 and having a threaded connection with the slide block 66, provides for control of the up and down adjustment of the upper straightening roller 61. The lead screw 67 is rotatable by means of an actuator 68, such as a knob or a hand wheel that is secured to its projecting upper end.

No difficulty has been experienced in achieving proper adjustment of the straightening rollers 61, 62 empirically. This is done by observing the amount of twist in the finished louver, and if the louver retains some of the twist imparted to it by the fin forming rollers 19, 20, the straightening rollers 61, 62 are brought closer together until untwisted products are obtained. If the finished pieces have a twist in the direction opposite to the one due to fin forming, the straightening rollers 61, 62 are too close together and must be adjusted to increase the gap between them, so that they effect a decreased rebending. Although such adjustment is a trial-and-error procedure, the proper roller gap is usually found with no more than a few trials, and, once established, it need not be changed unless there is a change in the material being worked, or in the fin forming rollers.

Since the strip passes through a succession of flange forming rollers before it arrives at the straightening rollers 61, 62, it moves towards each pair of flange forming rollers ahead of the straightening rollers with a small but visible twist. In the nip of each flange forming roller pair, however, the strip is confined against yielding to its internal twisting forces, and no difficulty is experienced with partial formation of the flanges before the strip is straightened.

The forming of the flanges 7 leaves residual stresses in the louver that tend to bow it along its length, but such residual stresses are symmetrical to the longitudinal centerline of the strip and therefore do not impart any twist to it. Furthermore, expedients for correcting such lengthwise bowing tendencies in a roller formed strip are well known in the art. For example, as the strip emerges from the nip of the flange forming rollers at the final roller stand 11g, it may encounter vertically adjustable rollers (not shown) which engage under its flanges 7 and impart an upward bowing force, producing residual bowing stresses that oppose and offset those resulting from forming of the flanges.

From the foregoing description taken with the accompanying drawings it will be apparent that this invention provides a machine for roller forming elongated flat metal stock into louvers and grills that are straight and untwisted even though they have long, narrow, laterally adjacent fins that extend parallel to the length of the strip and are all bent out of the plane of the strip in a configuration that tends to impose laterally asymmetrical twisting forces upon it.

What is claimed as the invention is:

1. A roller forming machine for producing groups of long, narrow, laterally adjacent louver fins in a strip of metal, each fin having its length parallel to the length of the strip and being laterally inclined to the plane of the strip, substantially every fin being inclined in one oblique direction, said machine being characterized by:

A. a pair of cooperating forming rollers between which the strip passes lengthwise in an advancing direction and by which the strip is slitted to define the fins and the fins are bent out of the plane of the strip in said oblique direction to a first acute angle to said plane;

B. a pair of straightening rollers spaced in said advancing direction from said forming rollers and having opposing substantially cylindrical surface portions which engage the fins to bend them partially back towards coplanar relationship with the remainder of the strip and thus to a second and smaller acute angle to said plane, thereby producing a set of residual stresses in the strip that oppose the set of residual stresses produced by bending the fins to said first acute angle; and C. means for adjustingly shifting one of said straightening rollers towards and from the other one, for increase and decrease, respectively, of the magnitude of the residual stresses produced by the straightening rollers, so that the sets of residual stresses in the strip can be brought to a substantial equilibrium wherein each said set of residual stresses prevents the other from imposing a twist upon the strip.

2. In apparatus comprising a pair of forming rollers through the nip of which a metal strip moves lengthwise in an advancing direction and by which louver fins are formed in the strip that are elongated lengthwise of the strip and are bent out of the plane of the strip to be laterally inclined in an oblique direction to said plane, straightening means for eliminating from the strip a twist along its length imposed by asymmetrical residual stresses generated in the strip material by formation of the louver fins, said straightening means comprising:

A. means defining a pair of opposing surfaces between which the strip can pass and by which the fins are engaged and are bent partway back towards coplanar relationship with the remainder of the strip, to thereby generate in the strip other residual stresses which oppose and counterbalance the first mentioned residual stresses; and B. means for moving the strip lengthwise between said surfaces.

3. The apparatus of claim 2 wherein said means defining a pair of opposing surfaces comprises a pair of straightening rollers having opposing cylindrical surfaces for engaging the fins, further characterized by:

C. means mounting one of said straightening rollers for adjusting motion toward and from the other one.

* * * * *